US010578108B2

(12) United States Patent
Ahn et al.

(10) Patent No.: US 10,578,108 B2
(45) Date of Patent: Mar. 3, 2020

(54) ELECTRIC COMPRESSOR

(71) Applicant: Hanon Systems, Daejeon (KR)

(72) Inventors: Hyun Seong Ahn, Daejeon (KR); Kweon Soo Lim, Daejeon (KR); Chi Myeong Moon, Daejeon (KR); Soo Cheol Jeong, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 435 days.

(21) Appl. No.: 15/025,653

(22) PCT Filed: Jun. 19, 2015

(86) PCT No.: PCT/KR2015/006246

§ 371 (c)(1),
(2) Date: Dec. 2, 2017

(87) PCT Pub. No.: WO2016/143951

PCT Pub. Date: Sep. 15, 2016

(65) Prior Publication Data

US 2018/0080447 A1 Mar. 22, 2018

(30) Foreign Application Priority Data

Mar. 6, 2015 (KR) ..... 10-2015-0031823

(51) Int. Cl.
*F04B 39/02* (2006.01)
*F04C 29/02* (2006.01)
(Continued)

(52) U.S. Cl.
CPC ..... *F04C 29/0035* (2013.01); *F04C 18/0215* (2013.01); *F04C 23/008* (2013.01);
(Continued)

(58) Field of Classification Search
CPC .... F04B 39/0284; F04C 29/02; F04C 29/026; F04C 29/028; F04C 29/12; F04C 29/065; F04C 18/0215
(Continued)

(56) References Cited

U.S. PATENT DOCUMENTS 4,279,578 A * 7/1981 Kim ..... F04C 28/28 418/97
5,733,108 A * 3/1998 Riffe ..... F04B 39/0011 417/542
(Continued)

FOREIGN PATENT DOCUMENTS

KR 20130126837 A 11/2013
WO 2012138101 A2 10/2012

*Primary Examiner* — Deming Wan
(74) *Attorney, Agent, or Firm* — Shumaker, Loop & Kendrick, LLP; James D. Miller

(57) ABSTRACT

The present invention relates to an electric compressor. The electric compressor according to an exemplary embodiment of the present invention includes a rear housing in which a discharging chamber to which a coolant is discharged is formed; an oil separator disposed in the discharging chamber, having a coolant introduction hole through which the coolant is introduced formed therein and disposed to be eccentric to one side of the rear housing; a partitioning wall partitioning an inner region of the discharging chamber into different regions and having communication portions formed at different positions; and a resonance chamber in which introduction and diffusion of the coolant passing through the communication portions are simultaneously performed.

20 Claims, 4 Drawing Sheets

(51) Int. Cl.

| | |
|---|---|
| ***F04C 29/12*** | (2006.01) |
| ***F04C 29/06*** | (2006.01) |
| ***F04C 18/02*** | (2006.01) |
| ***F04C 29/00*** | (2006.01) |
| ***F04C 23/00*** | (2006.01) |
| *F04C 18/34* | (2006.01) |

(52) U.S. Cl.
CPC ..... *F04C 29/026* (2013.01); *F04C 29/065* (2013.01); *F04C 29/068* (2013.01); *F04C 29/12* (2013.01); *F04C 18/34* (2013.01); *F04C 2240/30* (2013.01)

(58) Field of Classification Search
USPC ..... 418/55.6
See application file for complete search history.

(56) References Cited

U.S. PATENT DOCUMENTS

| | | | | |
|---|---|---|---|---|
| 2005/0106041 | A1* | 5/2005 | Kitamura | F01C 21/0863 417/313 |
| 2010/0307343 | A1* | 12/2010 | Nomura | F01C 21/10 96/216 |
| 2013/0251548 | A1 | 9/2013 | Ohno et al. | |

* cited by examiner

ELECTRIC COMPRESSOR

CROSS-REFERENCES TO RELATED APPLICATIONS

The patent application is a United States national phase patent application based on PCT/KR2015/006246 filed on Jun. 19, 2015, which claims the benefit of Korean Patent Application No. 10-2015-0031823 filed on Mar. 6, 2015. The entire disclosures of the above patent applications are hereby incorporated herein by reference.

BACKGROUND OF THE INVENTION

Field of the Invention

Exemplary embodiments of the present invention relate to significantly reducing a pulsation pressure in a rear housing in which a discharging chamber discharging a coolant in a high-pressure state is formed, and more particularly, relates to an electric compressor for decreasing the pulsation pressure by using a difference in a moving time of the coolant and diffusion phenomenon.

Description of the Related Art

Generally, a compressor used in an air-conditioning system introduces a coolant evaporated in an evaporator, changes the coolant into a high-temperature and high-pressure state in which the coolant may easily be liquefied and then transmits the coolant to a condenser, and the compressor is operated to compress the coolant moved via the evaporator.

The compressor includes a reciprocating compressor in which a driving source for compressing a coolant reciprocates to perform compression and a rotary compressor for performing compression by rotation. The reciprocating compressor includes a crank compressor transferring driving force of the driving source to a plurality of pistons by using a crank, a swash plate compressor transferring driving force to a rotation shaft in which a swash plate is installed, and a wobble plate compressor using a wobble plate.

The rotary compressor includes a vane rotary compressor using a rotating rotary shaft and a vane, and a scroll compressor using a rotating scroll and a fixed scroll. In the rotary compressor, the swash plate compressor, and the wobble plate compressor, vibration is generated when the high-pressure coolant is discharged to the discharging chamber, and in a case in which such vibration is continued for a specific time and is not attenuated, a pulsation phenomenon is caused in the discharging chamber, such that vibration is generated in the compressor, and abnormal vibration is caused in a vehicle in which the compressor is mounted or the air-conditioning system. Accordingly, a countermeasure therefor is required.

SUMMARY OF THE INVENTION

An object of the present invention relates to an electric compressor in which communication portions through which a coolant is introduced into an oil separator with a time difference are formed in a partitioning wall disposed in a rear housing to significantly reduce a pulsation pressure caused by a discharge of the coolant in the electric compressor.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, an electric compressor includes: a rear housing 100 in which a discharging hole and a discharging chamber 110 to which a coolant is discharged are formed; an oil separator 200 disposed in the discharging chamber 110, having a coolant introduction hole 202 through which the coolant is introduced formed therein and disposed to be eccentric to one side of the rear housing 100; a partitioning wall 300 partitioning an inner region of the discharging chamber 110 into different regions and having communication portions 310 formed at different positions; and a resonance chamber 400 partitioned by the partitioning wall and having the coolant introduction hole disposed therein, in which each of the communication portions is disposed at different distances from the discharging hole.

The discharging chamber 110 may have a first area based on the partitioning wall 300, and the resonance chamber 400 may have a second area relatively smaller than that of the discharging chamber 110 and may be positioned at one side of an upper portion of the discharging chamber 110.

The partitioning wall 300 may include a first partitioning wall 302 extending along a length direction of the oil separator 200; and a second partitioning wall 304 extending to be inclined toward one side of the discharging chamber 110 from a lower end of the first partitioning wall 302.

The communication portions 310 may include a first communication portion 312 formed at a position adjacent to the coolant introduction hole 202; and a second communication portion 314 formed at a position spaced apart from the coolant introduction hole 202, the first and second communication portions 312 and 314 may be opened toward different regions of the resonance chamber 400, respectively, the second communication portion being opened toward a lower side of the resonance chamber 400.

The first communication portion 312 is formed at a position relatively above that of the second communication portion 314.

An inner circumferential surface of the first communication portion 312 may be formed to be rounded, and all of inner circumferential surfaces of the second communication portion 314 may be formed to be rounded, or any one surface of the second communication portion 314 may be formed to be rounded and the other surface thereof may be formed to be inclined toward the resonance chamber 400.

The first communication portion 312 may be opened at a position facing the coolant introduction hole 202 and extend in a convergent tube form of which a diameter is decreased toward the coolant introduction hole 202.

When a plurality of coolant introduction holes 202 are provided and spaced apart from each other in a length direction of the oil separator 200, the first communication portion 312 may be opened toward between the coolant introduction holes 202 spaced apart from each other to guide the coolant to move to the coolant introduction holes 202.

An opened area of the second communication portion 314 may be larger than that of the first communication portion 312, and the second communication portion 314 may be opened at an arbitrary position in the remaining section of the partitioning wall other than a protruded outer circumferential surface of the oil separator 200.

The second communication portion 314 may be opened at a position of one side of the partitioning wall 300 spaced apart from a protruded outer circumferential surface of the oil separator 200.

A tilt angle formed by arbitrary straight lines each extending from opened centers of the first and second communication portions 312 and 314 and crossing each other may be maintained to be 30 to 50 degrees.

The resonance chamber 400 may be positioned at an upper side of the discharging chamber 110 as compared to the discharging hole 101, and a filter unit 10 in which an oil separated by passing through the oil separator 200 is filtered may be disposed at a position of a lower side of the resonance chamber 400.

In a lower side of the filter unit 10, an oil pocket 20 formed at a lower portion of the oil separator 200 is formed, and in the oil pocket 20, a state in which the oil separated in the oil separator 200 is collected may be maintained.

In accordance with another aspect of the present invention, an electric compressor includes: a rear housing 1000 in which a discharging hole and a discharging chamber 1100 to which a coolant passing through a back pressure chamber of a compression unit 5 is discharged is formed; an oil separator 2000 disposed at the center of the discharging chamber 1100 and having a coolant introduction hole 2002 through which the coolant is introduced formed therein; a partitioning wall 3000 partitioning an inner region of the discharging chamber 1100 into different regions and having communication portions 3100 formed at different positions so that moving time of the coolant introduced to the coolant introduction hole 2002 from the discharging hole is different; and a resonance chamber 4000 partitioned by the partitioning wall and having the coolant introduction hole disposed therein.

The resonance chamber 4000 may be divided based on the oil separator 2000 to allow the coolant to move, and be formed at an upper side of the discharging chamber 1100 based on the oil separator 2000.

The partitioning wall 3000 may extend from an upper portion of one side of the discharging chamber 1100 to the other side while crossing the oil separator 2000.

The communication portions 3100 may include a first communication portion 3110 formed at a position adjacent to the coolant introduction hole 2002; and a second communication portion 3120 formed at a position spaced apart from the coolant introduction hole 2002, and a height difference between the first and second communication portions 3110 and 3120 may be maintained, the first communication portion 3110 being opened at a position facing the coolant introduction hole 2002 and extending in a convergent tube form of which a diameter is decreased toward the coolant introduction hole 2002.

The second communication portion 3120 may be opened at an arbitrary position in the remaining section of the partitioning wall 3000 other than a protruded outer circumferential surface of the oil separator 2000 and may be formed in plural in the partitioning wall 3000.

A coolant introduced through the first communication portion 3110 may directly move toward an inner side of the oil separator 2000 through the coolant introduction hole 2002 and a coolant introduced through the second communication portion 3120 may move toward the inner side of the oil separator 2000 through the coolant introduction hole 2002 after diffusing in the resonance chamber 4000 to reduce pulsation pressure due to the introduction of the coolant.

A filter unit 10 in which an oil separated by passing through the oil separator 2000 is filtered is disposed at a position of a lower side of the resonance chamber 4000.

According to exemplary embodiments of the present invention, it is possible to significantly reduce the pulsation pressure caused by the discharge of the coolant which is a working fluid of the electric compressor to suppress the unnecessary noise generation and promote quiet operation of the installation target in which the electric compressor is installed.

According to exemplary embodiments of the present invention, it is possible to enable stable movement of the coolant and stable separation of the oil included in the coolant by changing the structure so that flow resistance of the coolant moved to the oil separator is significantly decreased in consideration of the moving path and the moving time of the coolant discharged to the discharging chamber.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

An electric compressor according to a first exemplary embodiment of the present invention will be described with reference to the drawings. For reference, FIG. 1 is a longitudinal cross-sectional diagram illustrating a whole configuration of the electric compressor according to the first exemplary embodiment of the present invention, FIG. 2 is a diagram illustrating a rear housing of the electric compressor according to the first exemplary embodiment of the present invention, and FIG. 3 is a diagram illustrating a separation distance and a tilt angle of the electric compressor according to the first exemplary embodiment of the present invention.

Figure 1:
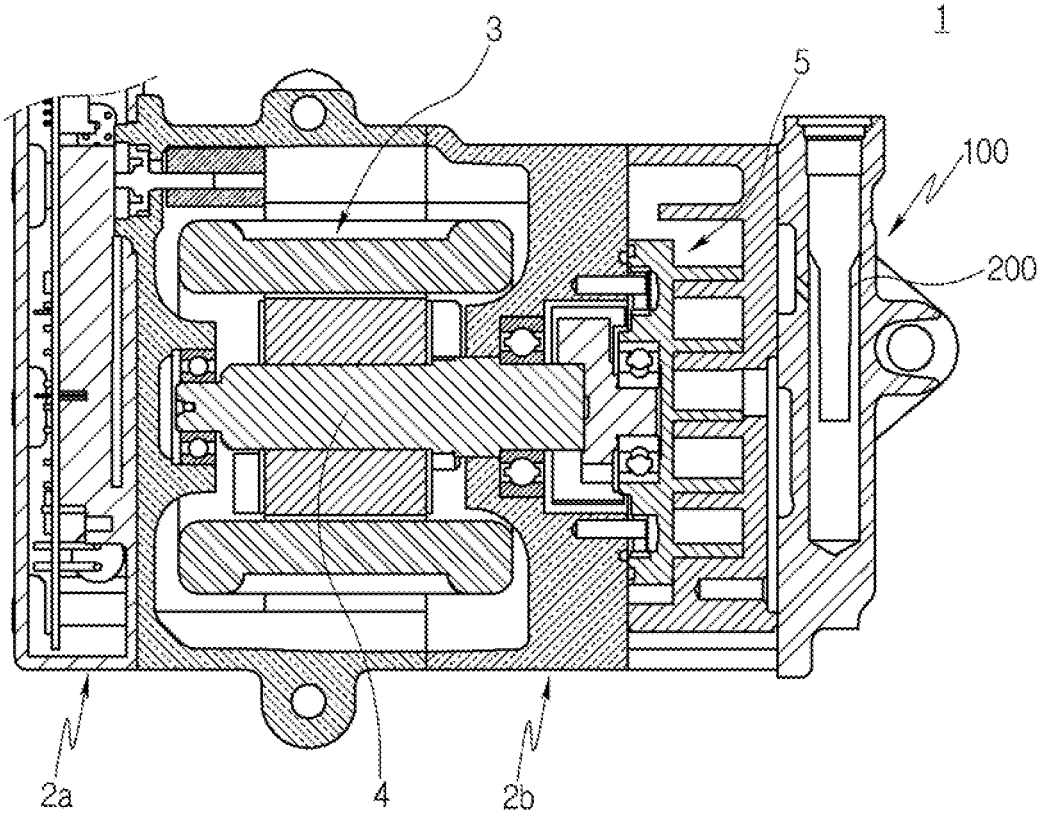
FIG. 1 is a longitudinal cross-sectional diagram illustrating a whole configuration of an electric compressor according to a first exemplary embodiment of the present invention.
Figure 2:
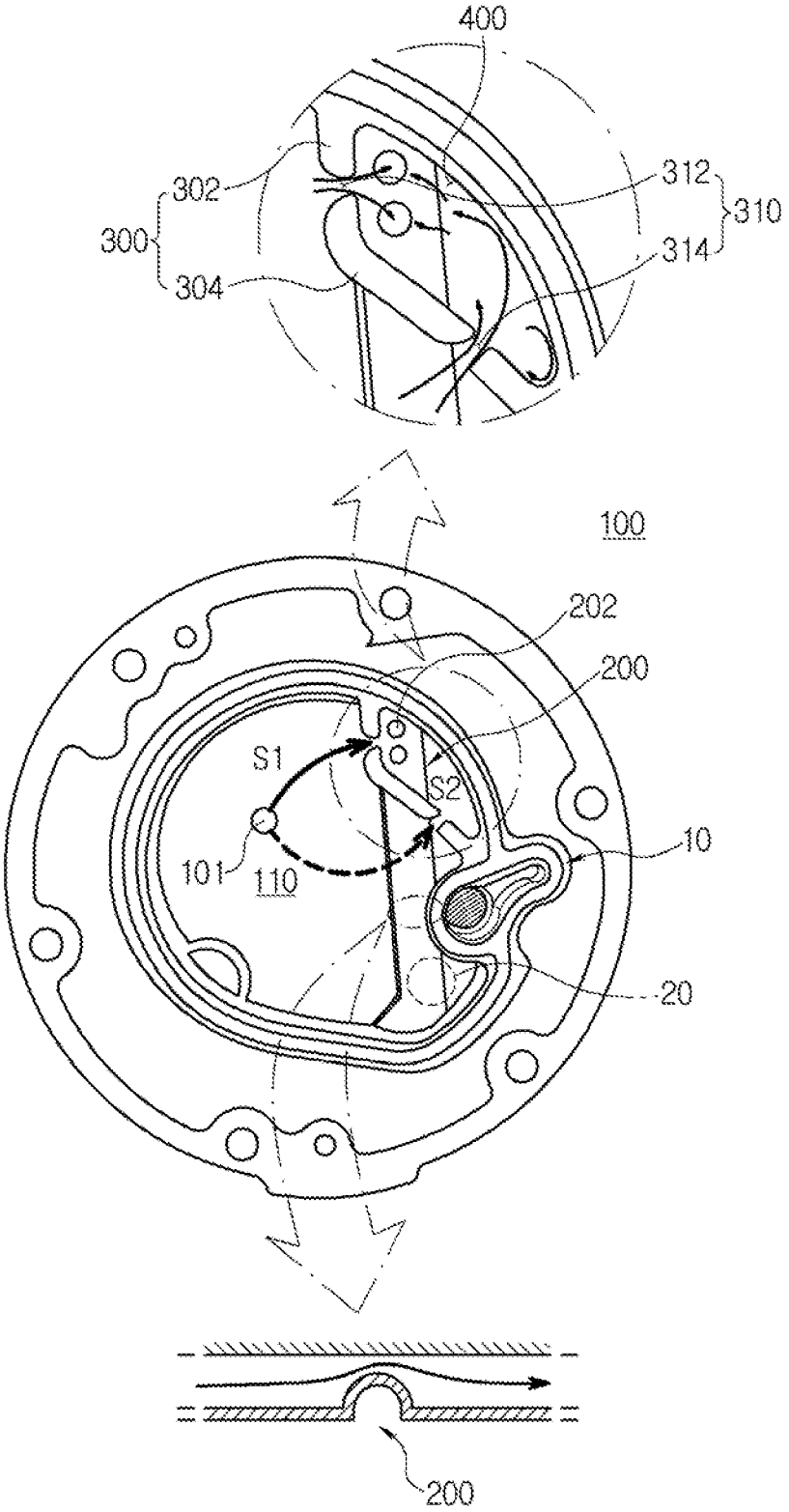
FIG. 2 is a diagram illustrating a rear housing of the electric compressor according to the first exemplary embodiment of the present invention.
Figure 3:
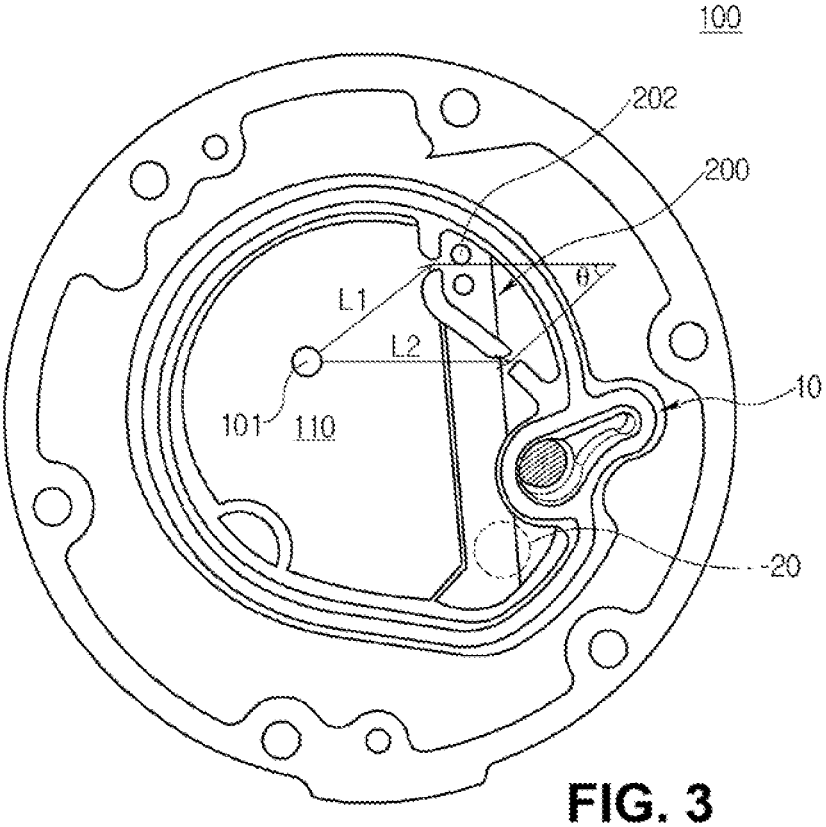
FIG. 3 is a diagram illustrating a separation distance and a tilt angle of the electric compressor according to the first exemplary embodiment of the present invention.

Referring to the accompanying drawings, FIGS. 1 to 3, as the electric compressor 1 according to the first exemplary embodiment of the present invention, a scroll compressor may be used to separate oil included in a coolant and reduce a pulsation pressure generated by the discharge of the coolant, but the electric compressor 1 is not necessarily limited thereto, but may be changed. As an example, the electric compressor 1 may be mounted in an air-conditioning system for a vehicle with an electric compressor or, may be used in a compression unit for industrial use or in a residential air-conditioning system.

To this end, the electric compressor 1 according to the first exemplary embodiment of the present invention consists of a front housing 2*a* forming an appearance of the electric compressor 1 and formed at a position of an intake port through which a coolant is introduced, a middle housing 2*b*, and a rear housing 100. In the middle housing 2*b*, a driving unit 3 and a compression unit 5 are embedded, and the driving unit 3 includes a stator, a rotor and a rotation shaft 4 inserted into the center of the rotor.

Rotation force generated in the driving unit 3 is transferred to the compression unit 5 to perform a compression and a discharge of the coolant. The compression unit 5 includes a fixed scroll and an orbiting scroll, and the fixed scroll is maintained to be fixed in the electric compressor 1 and the orbiting scroll is installed to be eccentrically rotatable with respect to the fixed scroll to allow relative movement, thereby compressing the coolant.

The rear housing 100 is positioned at one end of the middle housing 2*b*. More specifically, the rear housing 100 is selectively and detachably installed on the middle housing 2*b* in a state in which it is closely adhered to a right end of the middle housing 2*b* in FIG. 1. The coolant discharged from the compression unit 5 is discharged toward a discharging chamber 110 through a discharging hole 101 via a back pressure chamber at a predetermined pressure, and the coolant discharged to the discharging chamber 110 is discharged at the pressure of approximately 30 bar.

In this case, when the coolant is discharged to the discharging chamber 110 at a specific pressure, a noise due to a pulsation may be generated. However, in the electric compressor 1 according to the present exemplary embodiment, an inner region of the discharging chamber 110 is partitioned by a partitioning wall 300 and in the partitioned discharging chamber 110, a resonance chamber 400 having a predetermined space is formed at one side of an oil separator 200.

Communication portions 310 are formed in the partitioning wall 300, and the coolant flows through the communication portion 310. Since the coolant is introduced from the discharging chamber 110 through the communication portions 310 at a different time, a phase difference occurs, such that pulsation noise is reduced. A description therefor will be described in more detail when describing the partitioning wall 300.

The discharging chamber 110 has a first area based on the partitioning wall 300 and the resonance chamber 400 has a second area relatively smaller than that of the discharging chamber 110 and is positioned at one side of an upper portion of the discharging chamber 110. The position of the resonance chamber 400 is associated with a position of the oil separator 200. For example, when the oil separator 200 is disposed to be eccentric to one side of the rear housing 100 as in the first exemplary embodiment, since the resonance chamber 400 is positioned at a position of an upper side of the oil separator 200, thus the resonance chamber 400 is also positioned at one side of the upper portion as described above.

The discharging chamber 110 and the resonance chamber 400 are positioned at specific positions to maximally utilize limited layout of the rear housing 100, enable stable movement of the coolant, and significantly reduce the pulsation pressure caused by the movement of the coolant to a coolant introduction hole 202 formed in the oil separator 200.

For example, in order for the oil to be stably separated by specific gravity difference after the coolant is discharged through the discharging hole 101 and introduced to the coolant introduction hole 202 formed in the oil separator 200, it may be relatively advantageous that the coolant introduction hole 202 is positioned at an upper side of the oil separator 200 in a length direction such that the coolant moves downward in the length direction of the oil separator 200 to stably separate the oil and recover pure coolant in a gas state. For such reason described above, it is preferable that the resonance chamber 400 is formed at a position in which the coolant introduction hole 202 is formed and it is advantageous that the resonance chamber 400 is formed at a position above that of the discharging hole 101 for the stable movement of the coolant and the reduction of the pulsation pressure.

The discharging chamber 110 has the first area S1, but the area of the discharging chamber 110 is not particularly limited to specific area, but is changed depending on a size of the rear housing 100. The resonance chamber 400 is limited to have the second area S2 relatively smaller than that of the discharging chamber 110, and a size of the resonance chamber 400 is formed at a specific ratio or less with respect to a size of the discharging chamber 110.

The rear housing 100 is formed to have a disc shape and includes a plurality of mounting holes for bolt coupling which are formed in a circumferential direction in order to be mounted on the middle housing 2*b*, and the discharging chamber 110 is formed therein as a separate region. The rear housing is sealed by a sealing member (not illustrated) as a medium to prevent leakage of the coolant to the outside, such that even when the high-pressure coolant is discharged to the discharging chamber 110, leakage does not occur.

In the rear housing 100, the discharging chamber 110 and the oil separator 200 in which the coolant introduction hole 202 through which the coolant moved to the discharging chamber 110 is introduced is formed are disposed. According to the first exemplary embodiment of the present invention, the oil separator 200 is limited to be disposed eccentrically to one side of the rear housing 100, and although the case in which two coolant introduction holes are formed at the upper side of the center of the oil separator 200 in the length direction is illustrated, the number of coolant introduction holes may be changed.

Further, the oil separator 200 is limited to be disposed in a vertical direction of the rear housing 100 and is formed in the rear housing 100 in a state in which it protrudes toward the inside of the discharging chamber 110 which is partitioned by the sealing member.

The oil separator 200 may have a hollow inner portion, and the oil included in the coolant introduced through the coolant introduction hole 202 moves downward of the oil separator 200, since it is relatively heavier and the coolant moves through the upper portion of the inside of the oil separator 200 due to specific gravity difference. Two coolant introduction holes 202 are opened in the vertical direction, and a region in which the coolant introduction hole 202 is formed corresponds to a region in which the resonance chamber 400 to be described below is formed.

The partitioning wall 300 according to the first exemplary embodiment of the present invention partitions the inner region of the discharging chamber 110 into different regions while crossing the oil separator 200 and has the communication portions 310 formed at different positions so that moving time of the coolants introduced to the coolant introduction hole 202 is different. The partitioning wall 300 includes a first partitioning wall 302 extending along the length direction of the oil separator 200 and a second partitioning wall 304 extending to be inclined toward one side of the discharging chamber 110 from a lower end of the first partitioning wall 302.

The first partitioning wall 302 according to the present exemplary embodiment is formed while crossing the oil separator 200 protruding toward the inner side of the discharging chamber 110 and vertically extends along a boundary region between the discharging chamber 110 and the protruding oil separator 200. The second partitioning wall 304 extends in a diagonal direction while crossing the oil separator 200 from the lower end of the first partitioning wall 302. Since a protruding surface of the partitioning wall except for the communication portions 310 closely adheres to one surface of the rear housing 100 mounted in a state of facing the protruding surface, leakage of the coolant through the partitioning wall 300 does not occur.

The partitioning wall 300 is processed to have a shape illustrated in the drawing by a cutting process, and the communication portions 310 are manufactured by primary hole machining using a drill and secondary additional processing to be in a state illustrated in the drawing.

The communication portions 310 include a first communication portion 312 formed at a position adjacent to the coolant introduction hole 202 and a second communication portion 314 formed at a position spaced apart from the coolant introduction hole 202. In order for the coolant to move to the first communication portion 312, the coolant moved through the discharging hole 101 moves along a first moving path as illustrated with a solid line arrow during moving time of a first time. Further, in order for the coolant to move to the second communication portion 314, the coolant moved through the discharging hole 101 moves along a second moving path as illustrated with a dotted line arrow during moving time of a second time. Since the coolant moved through the second communication portion 314 moves in a relatively delayed state as compared to the moving time of the coolant moved through the first communication portion 312, the pulsation pressure is reduced by the phase difference caused by the moving time and the overlap, such that the noise generation is relatively decreased thereby decreasing pulsation noise due to the operation of the electric compressor 1.

Further, when it is assumed that a straight-line distance from the center of the discharging hole 101 to the first communication portion 312 is a first separation distance L1, and a straight-line distance from the center of the discharging hole 101 to the second communication portion 314 is a second separation distance L2, since the second separation distance L2 is relatively longer than the first separation distance L1, in a case in which the coolant is introduced through the discharging hole 101, the coolant moving toward the first communication portion 312 moves faster than the coolant moving toward the second communication portion 314.

Based on such fact, the coolant introduced to the resonance chamber 400 is introduced in one direction, such that the pulsation pressure is not increased and a predetermined time delay is maintained after the coolant moves to the first communication portion 312 for the first time, and since the coolant is introduced to the resonance chamber 400 through the second communication portion 314, the pulsation pressure which may be generated in the electric compressor 1 is reduced, thereby stably maintaining a quiet operation.

Particularly, when the coolant moves to the first communication portion 312, it moves without passing through a complicated path in the discharging chamber 110. However, in order for the coolant to move to the second communication portion 314, the coolant primarily moves to a region in which the oil separator 200 is positioned in the discharging chamber 110, and secondarily moves along an outer circumferential surface of the oil separator 200 roundly protruding from the inner side of the discharging chamber 110 to a position in which the second communication portion 314 is formed. Accordingly, since the coolant moves to the resonance chamber 400 through the second communication portion 314 after t second time delay as compared to the coolant moved to the resonance chamber 400 through the first communication portion 312, the coolant moving through the second communication portion 314 is not introduced to the coolant introduction hole 202 simultaneously with the coolant moving through the first communication portion 312, but a time difference is generated therebetween depending on the movement of the coolant. Therefore, the pulsation pressure due to the introduction of the coolant is reduced, thereby significantly decreasing the noise generated in the electric compressor 1.

The second communication portion 314 according to the present exemplary embodiment is opened toward a circumferential direction of the resonance chamber 400. In this case, the coolant moves in the circumferential direction of the resonance chamber 400 facing the second communication portion 314 and then may not directly move toward the coolant introduction hole 202 but may diffuse in the resonance chamber 400 or move along an inner circumferential surface of the resonance chamber 400, therefore, the coolant moves to the coolant introduction hole 202 after t second time delay.

A tilt angle θ formed by arbitrary straight lines each extending from opened centers of the first and second communication portions 312 and 314 and crossing each other is maintained to be 30 to 50 degrees. In a case in which the tilt angle is less than 30 degrees, the position of the second communication portion 314 may be adjacent to the position of the first communication portion 312, thus it may be disadvantageous for the reduction of the pulsation pressure, and in a case in which the tilt angle is more than 50 degrees, the second communication portion 314 is opened at an end portion of the second partitioning wall 304, thus it may be disadvantageous for the processing and the moving path of the coolant moving toward the resonance chamber 400 becomes complicated, such that the effect of reducing the pulsation pressure may be reduced. Therefore, it is preferable that the tilt angle is formed within the above-described angle range.

The first communication portion 312 and the second communication portion 314 are opened toward different regions of the resonance chamber 400, respectively, and when the coolant is introduced into the resonance chamber 400 through the first communication portion 312, since the first communication portion 312 is disposed to face the coolant introduction hole 202 as described above, the coolant may directly move toward the coolant introduction hole 202 while diffusing within a minimum range.

Since the second communication portion 314 is formed at a position of the lower side of the resonance chamber 400, the coolant introduced into the resonance chamber 400 does not directly move toward the coolant introduction hole 202 but moves toward the coolant introduction hole 202 after diffusing in right lower portion in the drawing. As a result, the coolant moved through the second communication portion 314 has different moving path and moving process from the coolant moved through the first communication portion 312 by time delay caused by the diffusion and the movement.

The first communication portion 312 is formed at a position relatively upper than that of the second communication portion 314 in order to significantly reduce the pulsation pressure by using the time difference of the introduction of the coolant.

The first communication portion 312 has an inner circumferential surface formed to be rounded. This is to prevent a phenomenon that a flow of the coolant is drastically changed to turbulent flow in a case in which the inner circumferential surface is formed to be pointed when the high-pressure coolant moves to the resonance chamber 400 through the first communication portion 312. Further, in order to prevent the flow of the coolant from being changed to be unstable due to flow separation at the pointed portion, prevent the increase of the noise cause by such flow change and prevent the inner region of the resonance chamber 400 from being drastically changed into turbulent flow region, the inner circumferential surface of the first communication portion 312 may be formed to be rounded toward the outside as illustrated in the drawing, thereby simultaneously achieving the stable movement of the coolant and the noise reduction.

All the inner circumferential surfaces of the second communication portion 314 may be formed to be rounded, or any one surface may be formed to be rounded, and the other surface may be formed to be inclined toward the resonance chamber 400. A portion formed to be rounded among the inner circumferential surfaces of the second communication portion 314 may decrease flow resistance against the movement of the coolant to minimize the flow separation and suppress the turbulent flow from being generated like the foregoing first communication portion 312. Further, the portion extended to be inclined in the second communication portion 314 guides the coolant to directly move toward the circumferential direction of the resonance chamber 400, thereby stably promoting the diffusion of the coolant in the resonance chamber 400 to reduce the pulsation pressure.

The first communication portion 312 is opened at the position facing the coolant introduction hole 202 in a state in which it is maximally adjacent to the coolant introduction hole 202. This is to allow the coolant discharged through the discharging hole 101 to move toward the coolant introduction hole 202 at the shortest distance, thereby promoting the reduction of the pulsation pressure by the time difference depending on the movement of the coolant moving to the resonance chamber 400 and the coolant introduction hole 202 through the foregoing second communication portion 314.

The first communication portion 312 may extend in a convergent tube form of which a diameter is decreased toward the coolant introduction hole 202. In this case, the moving speed of the coolant toward the resonance chamber 400 is increased, such that a large amount of coolant may rapidly move to the resonance chamber 400. The converged tilt angle of the first communication portion 312 is not particularly limited, but when it is assumed that a diameter of an inlet of the first communication portion 312 is d, it is preferable that a diameter of an outlet extended toward the resonance chamber 400 is d/2.

Further, when a plurality of coolant introduction holes 202 are provided and spaced apart from each other in the length direction of the oil separator 200, the first communication portion 312 is opened toward between the coolant introduction holes 202 spaced apart from each other thereby guiding the coolant to move to the coolant introduction hole 202. In this case, the first communication portion 312 is not opened toward one side of the coolant introduction hole 202, thus a large amount of coolant may move toward between the coolant introduction holes 202, thereby rapidly moving the coolant to the coolant introduction hole 202 to reduce the pulsation pressure.

The first and second communication portions 312 and 314 are primarily punched by using a drill for processing, and then chamfering process is performed thereon to form the inner side thereof to be rounded, thereby completing the processing to have the form illustrated in the drawing.

The opened area of the second communication portion 314 according to the present exemplary embodiment is relatively larger than that of the first communication portion 312, and this is to promote the reduction of the pulsation pressure by diffusion of the coolant introduced into the resonance chamber 400 and to supply some of the large amount of coolant moved to the discharging chamber 110 to the resonance chamber 400 through the first communication portion 312 and supply the rest thereof to the resonance chamber 400 through the second communication portion 314.

The second communication portion 314 may be opened at an arbitrary position in the remaining section of the second partitioning wall 304 other than a protruded outer circumferential surface of the oil separator 200. Since the second communication portion 314 may be freely positioned at an arbitrary position in the remaining section other than the position adjacent to the protruding oil separator 200, the processing of the second communication portion 314 may be performed after setting the best position for the reduction of pulsation pressure through simulation.

Accordingly, the designer may accurately select the best position by performing a simulation for the best position of the second communication portion 314, thereby significantly reducing the pulsation pressure due to the discharging of the coolant in the electric compressor 1.

The second communication portion 314 according to the exemplary embodiment of the present invention may be opened at a position of one side of the second partitioning wall 304 spaced apart from the outer circumferential surface of the oil separator 200, and in this case, the second communication portion 314 is preferred to be opened at the position illustrated in FIG. 1.

In the electric compressor 1, a filter unit 10 in which the oil separated by passing through the oil separator 200 is filtered is disposed at a position of the lower side of the resonance chamber 400. The filter unit 10 is provided to filter foreign materials included in the oil separated through the oil separator 200, and is configured to include a filter frame in which a mesh-shaped filter body is seated.

An installation position of the filter unit 10 in the discharging chamber 110 is changed depending on the position of the oil separator 200 in order to perform filtering for the oil separated from the coolant before the oil discharged through an oil discharging hole (not illustrate) formed at a lower side of the foregoing oil separator 200 is supplied to the driving unit 3. When the oil separator 200 is eccentrically positioned at one side of the discharging chamber 110 as in the first exemplary embodiment of the present invention, the filter unit 10 is also positioned at the right side corresponding to one side of the oil separator 200 as illustrated in the drawing.

In a lower side of the filter unit 10, an oil pocket 20 formed at the lower portion of the oil separator 200 is formed. In the oil pocket 20, a state in which the oil separated in the oil separator 200 is collected is maintained. Since the oil pocket 20 is positioned at the lower side of the filter unit 10, the oil pocket 20 may stably store oil moved to the driving unit 3 through the foregoing filter unit 10 when a predetermined amount or more of oil is collected.

The resonance chamber 400 according to the present exemplary embodiment is positioned at an upper side as compared to the discharging hole 101, therefore, disposition of the oil separator 200, the filter unit 10, and the oil pocket 20 may be more easily performed, and diversity of overall layout and design of the rear housing 100 according to the moving direction of the coolant may be improved, thereby improving degree of freedom of design for designers.

An electric compressor according to a second exemplary embodiment of the present invention will be described with reference to the drawings.

Figure 4:
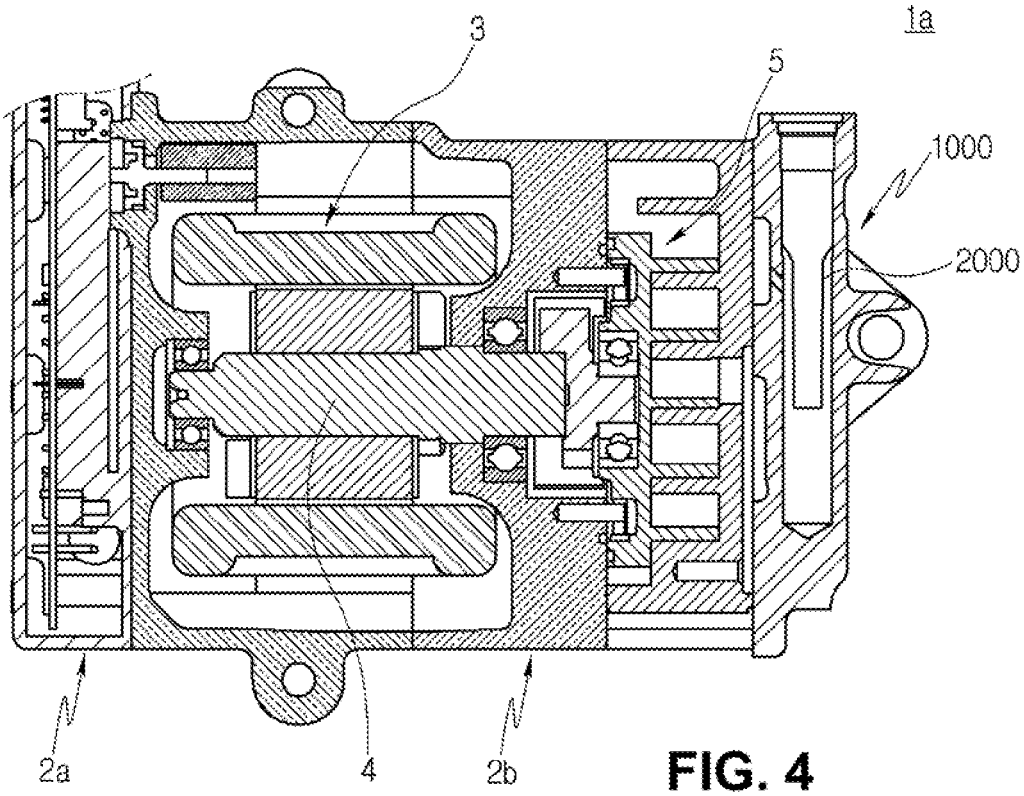
FIG. 4 is a longitudinal cross-sectional diagram illustrating a whole configuration of an electric compressor according to a second exemplary embodiment of the present invention.
Figure 5:
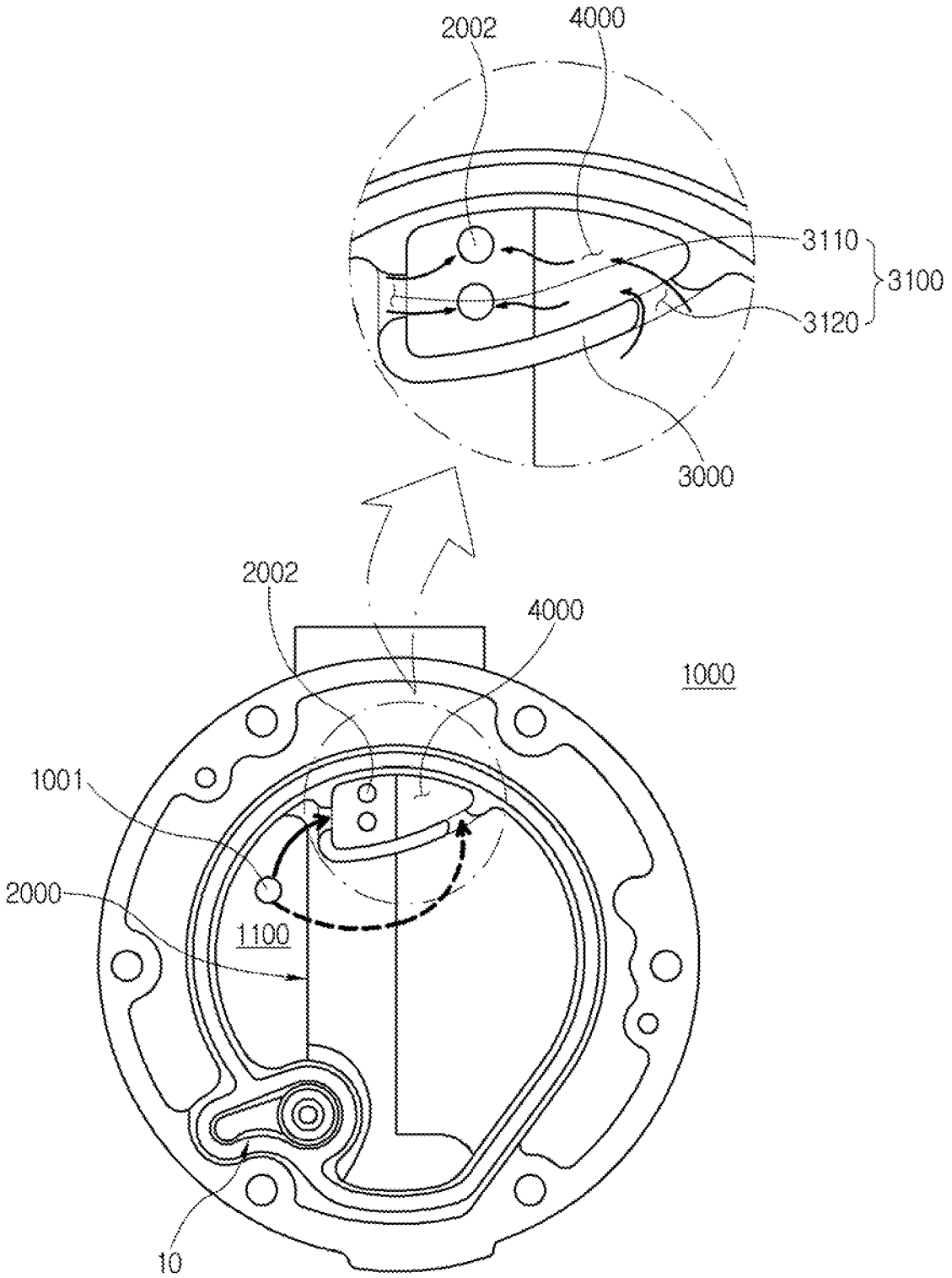
FIG. 5 is a diagram illustrating a rear housing of the electric compressor according to the second exemplary embodiment of the present invention.

Referring to accompanying FIGS. 4 and 5, as the electric compressor 1*a* according to the second exemplary embodiment, a scroll compressor may be used to separate oil included in a coolant and reduce a pulsation pressure generated by the discharge of the coolant as in the first exemplary embodiment described above, but the electric compressor 1*a* is not necessarily limited thereto, but may be changed. Further, the electric compressor 1*a* is different from that of the first exemplary embodiment in that an oil separator is positioned at the center.

To this end, the electric compressor 1*a* of the present invention includes a rear housing 1000 in which a discharging chamber 1100 to which the coolant passing through a back pressure chamber of the compression unit is introduced is formed, an oil separator 2000 in which a coolant introduction hole 2002 through which the coolant is introduced is formed, a partitioning wall 3000 partitioning an inner region of the discharging chamber 1100 into different regions while crossing the oil separator 2000 and having the communication portions 3100 formed at different positions so that moving time of the coolants introduced to the coolant introduction hole 202 is different, and a resonance chamber 4000 in which introduction and diffusion of the coolant passing through the communication portions 3100 are simultaneously performed.

Unlike the first exemplary embodiment described above, according to the present exemplary embodiment, the oil separator 2000 is disposed at the center of the discharging chamber 1100. More specifically, the oil separator 2000 may be positioned at the center or at a position biased toward one side from the center, and eccentricity of the oil separator 2000 is smaller than the oil separator of the first exemplary embodiment described above.

The resonance chamber 4000 is divided based on the oil separator 2000 to allow the coolant to move, and is formed at an upper side of the discharging chamber 1100 based on the oil separator 2000.

The discharging chamber 1100 has a first area based on the partitioning wall 3000 and the resonance chamber 4000 has a second area relatively smaller than that of the discharging chamber 1100 and is positioned at one side of an upper portion of the discharging chamber 1100. The position of the resonance chamber 4000 is associated with a position of the oil separator 2000. For example, when the oil separator 2000 is disposed at the center of the rear housing 1000 or disposed to be eccentric to the center of the rear housing 1000 as in the present exemplary embodiment, since the resonance chamber 4000 is positioned at an upper side of the oil separator 2000, thus the resonance chamber 4000 is also positioned at the central upper portion.

The discharging chamber 1100 and the resonance chamber 4000 are positioned at specific positions to maximally utilize limited layout of the rear housing 1000, enable stable movement of the coolant, and significantly reduce the pulsation pressure caused by the movement of the coolant to a coolant introduction hole 2002 formed in the oil separator 2000.

For example, in order for the oil to be stably separated by specific gravity difference after the coolant is discharged through the discharging hole 1001 and introduced to the coolant introduction hole 2002 formed in the oil separator 2000, it may be relatively advantageous that the coolant introduction hole 2002 is positioned at the central upper portion of the oil separator 2000 in a length direction such that the coolant moves downward in the length direction of the oil separator 2000 to stably separate the oil and recover pure coolant in a gas state. For such reason described above, it is preferable that the resonance chamber 4000 is formed at a position in which the coolant introduction hole 2002 is formed and it is advantageous that the resonance chamber 400 is formed at a position upper than that of the discharging hole 1001 for the stable movement of the coolant and the reduction of pulsation pressure.

The discharging chamber 1100 has the first area, but the area of the discharging chamber 1100 is not particularly limited to specific area, but is changed depending on a size of the rear housing 1000. The resonance chamber 4000 is limited to have the second area relatively smaller than that of the discharging chamber 1100, and a size of the resonance chamber 4000 is formed at a specific ratio or less with respect to the discharging chamber 1100.

In the rear housing 1000, the discharging chamber 1100 and the oil separator 2000 having the coolant introduction hole 2002 through which the coolant moved to the discharging chamber 1100 is introduced formed therein are disposed. According to the second exemplary embodiment of the present invention, the oil separator 2000 is limited to be disposed at the center of the rear housing 1000 or disposed to be biased to one side from the center of the rear housing 1000, and although the case in which two coolant introduction holes are formed at the upper side of the center of the oil separator 200 in the length direction is illustrated, but the number of coolant introduction holes may be changed.

Further, the oil separator 2000 is limited to be disposed in a vertical direction of the rear housing 1000 and is formed in the rear housing 100 in a state in which it protrudes toward the inside of the discharging chamber 1100 which is partitioned by the sealing member.

The oil separator 2000 may have a hollow inner portion, and the oil included in the coolant introduced to the coolant introduction hole 2002 moves downward through the oil separator 2000, since it is relatively heavier and the coolant moves while passing through the upper side of the oil separator 2000 due to a specific gravity difference. Two coolant introduction holes 2002 are opened in the vertical direction, and a region in which the coolant introduction hole 2002 is formed corresponds to a region in which the resonance chamber 4000 to be described below is formed.

The partitioning wall 3000 according to the second exemplary embodiment of the present invention partitions the inner region of the discharging chamber 1100 into different regions while crossing the oil separator 2000 and has the communication portions 3100 formed at different positions so that moving time of the coolants introduced to the coolant introduction hole 2002 is different. The partitioning wall 3000 extends from an upper portion of one side of the discharging chamber 1100 to the other side while crossing the oil separator 2000.

In the partitioning wall 3000 according to the present exemplary embodiment, a first communication portion 3110 and a second communication portion 3120 are formed to be spaced apart from each other. The first communication portion 3110 is disposed at a position relatively higher than the second communication portion 3120 and adjacent to the coolant introduction hole 2002, such that the high-pressure coolant discharged to the discharging chamber 1100 through the discharging hole 1001 may rapidly move toward the first communication portion 3110. Further, the coolant moves to the resonance chamber 4000 through the second communication portion 3120. Since the moving time when the coolant moved through the second communication portion 3120 moves is relatively delayed as compared to the moving time of the coolant moved through the first communication portion 3110, the pulsation pressure is reduced by the phase difference caused by the moving time and the overlapping, such that the noise generation is relatively decreased thereby decreasing pulsation noise due to the operation of the electric compressor 1*a*.

The partitioning wall 3000 is processed to have a shape illustrated in the drawing by a cutting process, and the communication portions 3100 are manufactured by primary hole machining using a drill and secondary additional processing to be in a state illustrated in the drawing.

The second communication portion 3120 according to the present exemplary embodiment is opened toward a circumferential direction of the resonance chamber 4000. In this case, the coolant moves in the circumferential direction of the resonance chamber 4000 facing the second communication portion 3120 and then may not directly move toward the coolant introduction hole 2002 but may move to the coolant introduction hole 2002 after diffusing in the resonance chamber 4000 and being delayed for t seconds.

A tilt angle formed by arbitrary straight lines each extending from opened centers of the first and second communication portions 3110 and 3120 and crossing each other is maintained to be 30 to 50 degrees. In a case in which the tilt angle is less than 30 degrees, the position of the second communication portion 3120 may be adjacent to the position of the first communication portion 3110, thus it may be disadvantageous for the reduction of the pulsation pressure, and in a case in which the tilt angle is more than 50 degrees, the moving path of the coolant moving toward the resonance chamber 4000 becomes complicated, such that the effect of reducing the pulsation pressure may be decreased. Therefore, it is preferable that the tilt angle is formed within the above-described angle range.

The first communication portion 3110 and the second communication portion 3120 are opened toward different regions of the resonance chamber 4000, respectively, and when the coolant is introduced into the resonance chamber 4000 through the first communication portion 3110, since the first communication portion 3110 is disposed to face the coolant introduction hole 2002 as described above, the coolant may directly move toward the coolant introduction hole 2002 while diffusing within a minimum range.

Since the second communication portion 3120 is formed at a position of the lower side of the resonance chamber 4000, the coolant introduced into the resonance chamber 4000 does not directly move toward the coolant introduction hole 2002 but moves toward the coolant introduction hole 2002 after diffusing in right lower portion in the drawing. As a result, the coolant moved through the second communication portion 3120 has a different moving path and moving process from the coolant moved through the first communication portion 3110 by the time delay caused by the diffusion and the movement.

The first communication portion 3110 is formed at the position relatively upper than the second communication portion 3120. The position of the first communication portion 3110 only needs to be upper than that of the second communication portion 3120, and is not limited to the position illustrated in the drawing, but may be variously changed.

The first communication portion 3110 has an inner circumferential surface formed to be rounded. This is to prevent a phenomenon that a flow of the coolant is drastically changed to turbulent flow in a case in which the inner circumferential surface is formed to be pointed when the high-pressure coolant moves to the resonance chamber 4000 through the first communication portion 3110. Further, in order to prevent the flow of the coolant from being changed to be unstable due to flow separation at the pointed portion, prevent the increase of the noise cause by such flow change and prevent the inner region of the resonance chamber 4000 from being drastically changed into turbulent flow region, the inner circumferential surface of the first communication portion 3110 may be formed to be rounded toward the outside as illustrated in the drawing, thereby simultaneously achieving the stable movement of the coolant and the noise reduction.

All the inner circumferential surfaces of the second communication portion 3120 may be formed to be rounded, or any one surface may be formed to be rounded, and the other surface may be formed to be inclined toward the resonance chamber 4000. A portion formed to be rounded among the inner circumferential surfaces of the second communication portion 3120 may decrease flow resistance against the movement of the coolant to minimize the flow separation and suppress the turbulent flow from being generated like the foregoing first communication portion 3110. Further, the portion extended to be inclined in the second communication portion 3120 guides the coolant to directly move toward the circumferential direction of the resonance chamber 4000, thereby stably promoting the diffusion of the coolant in the resonance chamber 4000 to decrease the pulsation pressure.

The first communication portion 3110 is opened at the position facing the coolant introduction hole 2002 in a state in which it is maximally adjacent to the coolant introduction hole 2002. This is to allow the coolant discharged through the discharging hole 1001 to move toward the coolant introduction hole 2002 at the shortest distance, thereby promoting the reduction of the pulsation pressure by the time difference depending on the movement of the coolant moving to the resonance chamber 4000 and the coolant introduction hole 2002 through the foregoing second communication portion 3120.

The first communication portion 3110 may extend in a convergent tube form of which a diameter is decreased toward the coolant introduction hole 2002. In this case, the moving speed of the coolant toward the resonance chamber 4000 is increased, such that a large amount of coolant may rapidly move to the resonance chamber 4000.

The opened area of the second communication portion 3120 according to the present exemplary embodiment is relatively larger than that of the first communication portion 3110, and this is to promote the reduction of the pulsation pressure by diffusion of the coolant introduced into the resonance chamber 4000 and to supply some of the large amount of coolant moved to the discharging chamber 1100 to the resonance chamber 4000 through the first communication portion 3110 and supply the rest thereof to the resonance chamber 4000 through the second communication portion 3120.

The second communication portion 3120 may be opened at an arbitrary position in the remaining section of the partitioning wall 3000 other than a protruded outer circumferential surface of the oil separator 2000. Since the second communication portion 3120 may be freely positioned at an arbitrary position in the remaining section other than the position adjacent to the oil separator 2000, the processing of the second communication portion 3120 may be performed after setting the best position for the reduction of pulsation pressure through simulation.

In the electric compressor 1*a*, a filter unit 10 in which the oil separated by passing through the oil separator 2000 is filtered is disposed at a position of the lower side of the resonance chamber 4000. The filter unit 10 is provided to filter foreign materials included in the oil separated through the oil separator 2000, and is configured to include a filter frame in which a mesh-shaped filter body is seated. An installation position of the filter unit 10 in the discharging chamber 1100 is changed depending on the position of the oil separator 2000 in order to perform filtering for the oil separated from the coolant before the oil discharged through an oil discharging hole (not illustrate) formed at a lower side of the foregoing oil separator 2000 is supplied to the driving unit 3.

The resonance chamber 4000 according to the present exemplary embodiment is positioned at an upper side as compared to the discharging hole 1001, therefore, disposition of the oil separator 2000 and the filter unit 10 may be more easily performed, and diversity of overall layout and design of the rear housing 1000 according to the moving direction of the coolant may be improved, thereby improving degree of freedom of design for designers.

A scroll compressor having a rear housing according to another exemplary embodiment of the present invention mounted therein may be provided and used by being mounted in a vehicle.

An air-conditioning system for a vehicle having an electric compressor according to still another exemplary embodiment of the present invention mounted therein may be provided and the vehicle may include a general car, a special vehicle, or an industrial vehicle.

INDUSTRIAL APPLICABILITY

The exemplary embodiments of the present invention is to provide an electric compressor capable of allowing a coolant discharged to a discharging chamber to move with a time difference such that stable oil separation may be performed.

What is claimed is:

1. A compressor comprising:

a rear housing having a discharging chamber and a discharging hole formed therein, the discharging hole configured to discharge a coolant into the discharging chamber;

an oil separator disposed in the discharging chamber and including a first coolant introduction hole formed therein, the first coolant introduction hole configured to convey the coolant from the discharging chamber into the oil separator;

a partitioning wall partitioning the discharging chamber into a first portion and a second portion, the first portion including the discharging hole and the second portion forming a resonance chamber having the first coolant introduction hole positioned therein, the partitioning wall including a first communication portion and a second communication portion, each of the first communication portion and the second communication portion fluidly coupling the first portion of the discharging chamber to the resonance chamber, wherein the first communication portion is spaced from the discharging hole by a distance different from a distance the second communication portion is spaced from the discharging hole.

2. The compressor according to claim 1, wherein the first portion of the discharging chamber has a first area and the second portion of the discharging chamber has a second area, wherein the second area is smaller than the first area, and wherein the resonance chamber is disposed in an upper portion of the discharging chamber in a gravity direction.

3. The compressor according to claim 1, wherein the partitioning wall includes a first partitioning wall extending along a length direction of the oil separator and a second partitioning wall extending at an angle relative to the first partitioning wall.

4. The compressor according to claim 1, wherein the first communication portion is spaced from the first coolant introduction hole by a distance smaller than a distance the second communication portion is spaced apart from the first coolant introduction hole.

5. The compressor according to claim 4, wherein the first communication portion is disposed above the second communication portion in a gravity direction.

6. The compressor according to claim 4, wherein at least a portion of an inner circumferential surface of the first communication portion is arcuate and at least a portion of an inner circumferential surface of the second communication is arcuate.

7. The compressor according to claim 4, wherein the first communication portion has a convergent tube shape with a decreasing diameter extending in a direction toward the first coolant introduction hole.

8. The compressor according to claim 4, further comprising a second coolant introduction hole formed in the oil separator and spaced from the second coolant introduction hole in a length direction of the oil separator, wherein the first communication portion opens in a direction toward a space formed between the first coolant introduction hole and the second coolant introduction hole.

9. The compressor according to claim 4, wherein an opened area of the second communication portion is larger than an opened area of the first communication portion.

10. The compressor according to claim 4, wherein the oil separator has a protruded outer circumferential surface extending into the discharging chamber, and wherein the second communication portion opens in a direction toward a portion of the resonance chamber spaced from the protruded outer circumferential surface of the oil separator.

11. The compressor according to claim 10, wherein the second communication portion opens toward an inner circumferential surface of the rear housing defining a portion of the resonance chamber.

12. The compressor according to claim 4, wherein the first communication portion opens in a direction facing in a first direction and the second communication portion opens in a direction facing in a second direction, and wherein an angle formed between the first direction and the second direction is between 30 and 50 degrees.

13. The compressor according to claim 1, further comprising a filter unit receiving an oil separated from the coolant in the oil separator, wherein at least a portion of the resonance chamber is disposed above the discharging hole in a gravity direction and the filter unit is disposed below the resonance chamber in the gravity direction.

14. The compressor according to claim 13, wherein an oil pocket collecting the oil separated from the coolant in the oil separator is formed in a lower side of the filter unit in the gravity direction.

15. The compressor according to claim 1, wherein the oil separator is disposed eccentrically to a side of the rear housing.

16. The compressor according to claim 1, wherein the oil separator is disposed in a center of the discharging chamber.

17. The compressor according to claim 16, wherein the resonance chamber is formed at an uppermost portion of the discharging chamber in a gravity direction.

18. The compressor according to claim 16, wherein a length direction of the oil separator extends parallel to a gravity direction.

19. The compressor according to claim 18, wherein the partitioning wall extends from a first side of an upper portion of the discharging chamber in the gravity direction to a second side of the upper portion of the discharging chamber opposing the first side of the upper portion and extending over the oil separator.

20. The compressor according to claim 1, wherein a first portion of the coolant flowing through the first communication portion flows directly toward the first coolant introduction hole and a second portion of the coolant flowing through the second communication portion flows toward the first communication portion after diffusing in the resonance chamber to minimize a pulsation pressure of the second portion of the coolant.

* * * * *